US006164315A

United States Patent [19]

Haslock et al.

[11] Patent Number: 6,164,315

[45] Date of Patent: Dec. 26, 2000

[54] APPARATUS FOR USE IN MANUFACTURE OF SUMP BASINS

[75] Inventors: John Haslock, Buchanan, Mich.; Craig Nowicki; Paul Schuchman, both of Granger, Ind.

[73] Assignee: Jackel, Inc., Mishawaka, Ind.

[21] Appl. No.: 09/374,290

[22] Filed: Aug. 16, 1999

[51] Int. Cl.[7] ..... F16K 51/00

[52] U.S. Cl. ..... 137/271; 137/565.17

[58] Field of Search ..... 137/271, 269, 137/565.17, 565.24; 417/363

[56] References Cited

U.S. PATENT DOCUMENTS 4,852,609 8/1989 Schoenauer ..... 137/565.17

5,025,834 6/1991 Stoll ..... 137/271 X 5,482,444 1/1996 Coha et al. ..... 417/363

5,890,879 4/1999 Rozek ..... 417/363

*Primary Examiner*—Kevin Lee

*Attorney, Agent, or Firm*—Ryan M. Fountain

[57] ABSTRACT

A template is provided for pump feet cups that is separately formed from the sump basin, positioned therein via sump basin flats to have a predetermined orientation with respect to the sump basin cover, and then attached to the sump basin to maintain a fixed position therein. A single template can be used with a variety of pump feet orientations by forming the template from a plurality of cups joined by a separable web. Foam or like material can be placed within the cups to receive the pump feet. Where the sump basin is formed from polyethylene material, the template can be molded from like material and then fixed to the lower interior surface of the sump basin by ultrasonic welding.

6 Claims, 1 Drawing Sheet

APPARATUS FOR USE IN MANUFACTURE OF SUMP BASINS

BACKGROUND AND SUMMARY OF THE INVENTION

The present invention relates generally to sewage ejector or sump basins, and, more particularly, to sewage ejector basins or sump arrangements that include therein pump devices for the removal of fluid from the basin.

Various prior devices are known which are required to receive and retain fluid, such as sewage or like waste. One such type of device is a sewage ejector basin or sump basin arrangement. Such sump basins arrangements will typically have an open topped sump container and a submersible electric pump or similar device mounted within it to remove fluid that accumulates in the sump container. Usually, it is desirable to seal the pump within the sewage or sump container by a rigid cover. Accordingly, an output pipe is often used which extends from the output of the pump through the cover. To maintain efficient manufacturing costs and for system reliability, especially where the sump basin is used with fluid under pressure, that output pipe is typically substantially rigid.

One of the more efficient arrangements of the pump within the sump basin, is to mount the pump at or about the lower portion of the sump, with downwardly extending legs or feet of the pump housing resting on the lower interior surface of the sump container. However, in operation of the pump, its torque and/or vibration have been found to cause the pump housing to tend to become displaced or to migrate about that lower interior surface. Such movement can stress the seals between the output pipe and the sump cover, permitting leakage therebetween, and possibly cause the output pipe to become separated from the pump and/or lower pump efficiency. In addition, if the pump moves into contact with the side walls of the sump, damage to the pump housing and/or the sump container can result as well as a higher level of operational noise may be created. Higher noise levels can also occur from vibration of the pump legs against the lower interior surface of the sump basin. Further, if more than one pump is employed in a given sump basin, relative movement between them can cause pump damage and interfere with the operation of one of more of the pumps. Moreover, where other devices are present in the sump, movement of the pump can interfere with effective operation of those other devices.

During assembly of sump basins prior to operation, it is usually necessary to carefully align the output pipe of the pump with an opening in the sump cover in order to create proper sealing between that pipe and the cover, especially where the sump basin is to be used with fluid under pressure. Given the typical size of sump basins, such alignment may require time consuming and careful placement of the pump within the sump and/or the use of special mounting jigs and/or formation of special lands or like locating features for alignment on the pump, sump basin and cover. Further, if the pumps are installed and properly positioned at the point of sump basin manufacture, incidental jostling and vibration during shipping can cause the pumps to become displaced from the initial position and/or damaged during shipping. If the pumps are installed and properly positioned on the jobsite, then each installer needs to have the appropriate equipment and skill to do so.

Previously, it has been suggested to form recesses or "cups" on the interior lower surface of the sump basin to receive and positively locate the pump or like devices. In sump basins of this type formed from polyethylene material, such cups were formed, for example, during the spin, rotational or vacuum molding of the sump basin, so as to be an integral part of the sump basin. Unfortunately, since each pump type usually has a distinct and special pattern for its feet or lower projections, each size and/or type of sump basin accommodating that pump type had to be specially formed with those receiving cups for that particular pump type. Thus, sellers of sump basins typically needed to maintain a larger variety of inventory or a longer lead time in supplying customers, if they are even able to service a wide range of pump applications at all. This problem was further complicated where more than one pump was to be used in a given sump basin, perhaps even of diverse size or make. In addition, since each so many different variations of sump size, type and cup patterns were involved, manufacturing and shipping costs were significantly increased. Further, the processes used to form the cups integrally with the sump basin can leave weak points in the sump basin structure.

Accordingly, it is an object of the present invention to provide improved sewage and sump basin arrangements. Other objects include the provision of an improved method and apparatus for receiving and locating pumps and like devices within sump basins that:

a. Is inexpensive to manufacture and easy to install, b. Reliably and accurately positions and supports the pump with respect to the cover during assembly and operation, c. Is usable with a wide variety of applications and pump types, d. Accommodates a plurality of diverse pumps in a single basin, e. Does not degrade the structural integrity of the sump basin, and f. Minimizes operational noise and component damage during shipment and operation.

These and other objects of the present invention are attained by the provision of a template of cups for the pump feet that is separately formed from the sump basin, positioned therein via sump basin flats to have a predetermined orientation with respect to the sump basin cover, and then attached to the sump basin to maintain a fixed position therein. A single template can be used with a variety of pump feet orientations by forming the template from a plurality of cups joined by a separable web. Foam or like material can be placed within the cups to receive the pump feet. Where the sump basin is formed from polyethylene material, the template can be molded from like material and then fixed to the lower interior surface of the sump basin by ultrasonic welding.

Other objects, advantages and novel features of the present invention will be readily apparent from the following drawings and description of preferred embodiments.

DETAILED DESCRIPTION OF PREFERRED EMBODIMENTS

Figure 1:
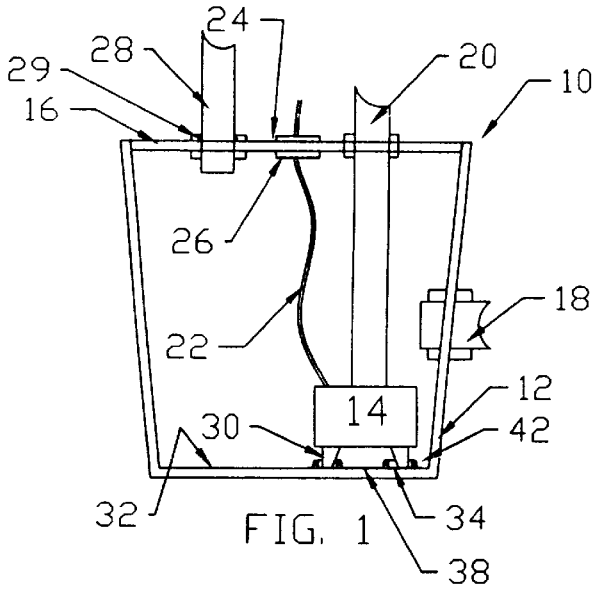
FIG. 1 shows a cross-sectional side view of a generalized sewage ejector basin or sump arrangement incorporating the present invention.
Figure 2:
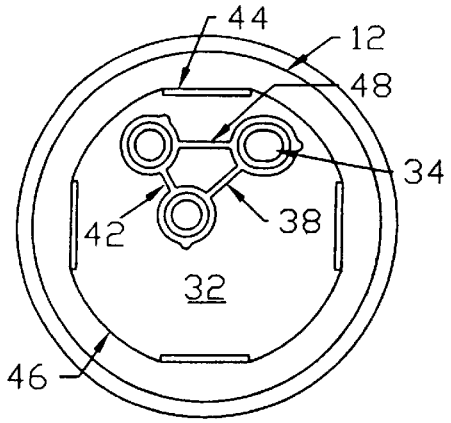
FIG. 2 shows an enlarged top view of the lower interior surface of the arrangement of FIG. 1, with the pump removed.
Figure 3:
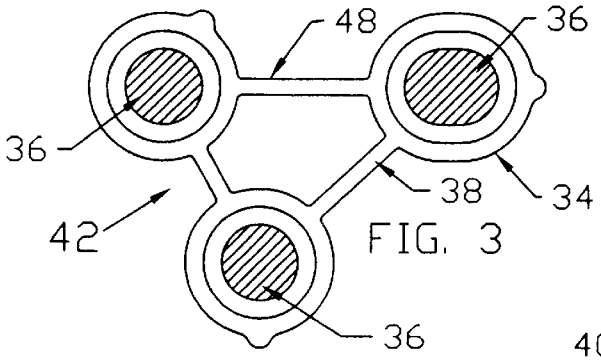
FIG. 3 shows a further enlarged top view of the cup template shown in FIG. 2.
Figure 4:
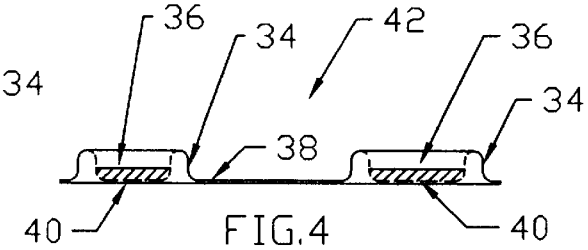
FIG. 4 shows a side view of the cup template of FIG. 2.

FIG. 1, which illustrates a preferred embodiment of the present invention, shows a sewage ejector basin or sump arrangement 10 with an open topped container 12 for receiving fluid, an electrical device 14, such as a submersible sump pump or other motor driven product, mounted within container 12, and a cover 16 for closing the top of container 12 and, for example, sealing fluid within container 12. An inlet pipe 18 is included to extend through either cover 16 or a side of container 12 and provide fluid to container 12. An outlet pipe 20 is included to extend from device 14 to and through either cover 16 or a side of container 12 and permit fluid to leave container 12. A power cord 22 is provided which is attached at one end to device 14 in order to supply electric power to device 14 from a source of electricity outside of container 12. Cover 16 includes an opening 24 therein for receiving the free end of power cord 22 and permitting it to leave container 12. Grommet 26 is provided to receive power cord 22 and seal opening 24 by insertion of a portion of grommet 26 into opening 24. Further, if desired for certain applications a vent pipe 28 can be provided which extends through cover 16. All pipes passing through cover 16 are preferably provided with fluid seals 29.

Device 14 is, for example, provided with lower projections or feet 30 to support it within container 12 at or adjacent to lower interior surface 32 of container 12. Recessed elements or cups 34 or like receptacles are mounted onto surface 32 and formed to closely receive feet 30. Preferably, one such cup 34 is provided to receive each of such feet 30. If desired in particular applications, foam or cushioning pads 36 can be placed within cups 34 and in contact with feet 30. These pads 36 can be formed from any suitable material and are intended to dampen vibration of feet 30 during operation. The particular configuration of cups 34 is formed to correspond with the configuration of the feet 30 to be received thereby, both in terms of the shape of the individual feet and in terms of the relative position of the feet with respect to each other.

The cups 34 for use in a given application are joined by web strands or arms 38 which extend, for example, outwardly from base surface 40 of each cup 34 in a flange-like manner toward the adjacent cup. Preferably, web arms 38 are relatively thin and are integrally formed with cups 34 to create an overall template 42 as an integral unit. This template is preferably separately formed from container 12.

In order to facilitate proper placement of template 42 within container 12, at least one portion of container 12, at the junction of a side wall and lower interior surface 32, for example, is formed with a predetermined configuration, such as a flat 44. It is preferable to form container 12 such that flat 44 is readily distinguishable from other portions of the container near that location. For example, other portions 46 of that junction of lower interior surface 32 and the side wall would have a curved or arcuate configuration.

One side of template 42 is formed with a mating flat 48 to correspond with or match and receive flat 44. To properly position template 42 within container 12, flats 44 and 48 are aligned and joined, although for purposes of clarity and understanding, flats 44 have been exaggerated and spaced apart from flats 48 in the drawings. While in that joined orientation, template 42 is fixed to lower interior surface 32. Where, for example, container 12 and template 42 are formed from polyethylene material, template 42 can be so fixed by ultrasonically welding base 40 of one or more of cups 34 to lower interior surface 32. Flat 44 is advantageously located within container 12 such that when template 42 is positioned within container 12 as described above and feet 30 are then closely received within cups 34, then device 14 will be properly positioned and positively located with respect to the opening in cover 16 (or the side of container 12) which is intended for outlet pipe 20.

Figure 5:
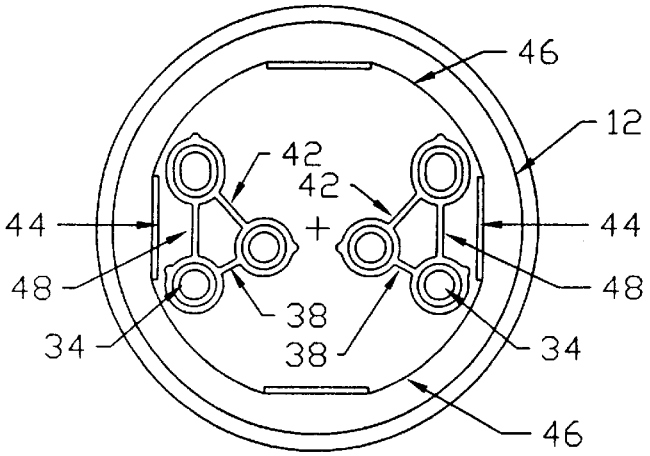
FIG. 5 shows a top view of the lower interior surface of a sump arrangement according to the present invention where a plurality of templates are employed.

For further simplification of manufacture, a single template can be used for multiple pump feet configurations by severing one or more of the relatively thin web arms 38 with or without removing one of the cups 34. Also, where a plurality of devices 14 are to be used within a given container 12, a plurality of templates 42 are likewise employed, positioned by a plurality of flats 44 in container 12, as shown in FIG. 5.

With this invention, a single form of standard sump basin can be used with one or more pump feet receiving templates to accommodate a wide variety to types and numbers of pumps. Sellers would have to inventory only that basin and the substantially smaller volume of templates needed for variety in applications. Shipping and handling expenses would be similarly reduced.

Although the present invention has been described above with respect to specific embodiments, that was done by way of illustration and example only and not as a limitation to invention. Those of ordinary skill in the art will now realize that within the present invention numerous other modifications and adaptations of specific embodiments can be made. For example, preferred embodiments have been described in detail with respect to sump arrangements, but are equally applicable to sewage or other plumbing arrangements. Further, the present invention can be applicable to fluids of both a liquid or gaseous nature. Also, the surfaces 44 used to orient templates 42 need not be flat or of any particular configuration so long as readily distinguishable to those involved in manufacture and suitable for abutment to flats 48 for the purposes described above. Accordingly, the spirit and scope of the present invention are limited only by the terms of the claims below.

What we claim is:

1. An arrangement for mounting motor driven devices within a sump basin or like container for receiving fluid, comprising:

a container having an interior support surface, a device mounted within the container adjacent the support surface, that device including at least one projection extending therefrom, and a template member, formed separately from the container and mounted to the support surface, having at least one receptacle for receiving the projection and positively locating the device in a predetermined desired location with respect to the container.

2. The arrangement according to claim 1 wherein the container is adapted to receive a variety of different devices either alone or in combination and a variety of different template members are provided to alternatively receive such devices.

3. The arrangement according to claim 1 wherein the device includes a plurality of projections and the template member includes a plurality of receptacles joined by a relatively thin web.

4. The arrangement according to claim 3 wherein the container includes a specially configured surface area and the template member includes a mating surface area such that junction of those two surface areas locates the template member at a predetermined orientation with respect to the container.

5. The arrangement according to claim 4 wherein a vibration dampening element is inserted within each of the receptacles of the template member adjacent the projections of the device.

6. The arrangement according to claim 5 wherein an output pipe is provided which is connected to the device, the container is provided with a separable cover with an opening for receiving therethrough the output pipe, and the elements of the arrangement are configured such that orientation of the device with respect to template causes the output pipe to align with the opening in the cover.

* * * * *